United States Patent [19]

Dinning

[11] 3,937,280

[45] Feb. 10, 1976

[54] ARTIFICIAL LIFT WELL APPARATUS

[75] Inventor: Robert W. Dinning, Houston, Tex.

[73] Assignee: Macco Oil Tool Company, Inc., New York, N.Y.

[22] Filed: Feb. 3, 1975

[21] Appl. No.: 546,440

[52] U.S. Cl. ..... 166/224 R; 138/114; 166/242

[51] Int. Cl.[2] ..... E21B 43/00; E21B 17/14

[58] Field of Search ..... 166/224, 242; 138/112, 138/114, 177

[56] References Cited

UNITED STATES PATENTS

| | | | |
|---|---|---|---|
| 3,379,259 | 4/1968 | Metler | 166/242 |
| 3,601,320 | 8/1971 | DuPlessis | 138/114 X |
| 3,827,491 | 8/1974 | Dinning | 166/242 |

*Primary Examiner*—James A. Leppink
*Attorney, Agent, or Firm*—David L. Moseley; William R. Sherman; Stewart F. Moore

[57] ABSTRACT

Artificial lift apparatus for use in a well having an outer pipe string for flow of a first fluid and an inner pipe string for flow of a second fluid. The apparatus may comprise a tubular receiver for connection in the inner pipe string and having ports for providing communication between the inner and outer pipe string. The receiver may include an inner tubular member and a concentrically surrounding outer tubular member defining an annular passageway therebetween through which at least a portion of the first fluid flow may pass. The apparatus may also include a well tool adapted for movement through the inner pipe string for engagement with the receiver inner tubular member and being provided with at least one valve for controlling fluid flow between the inner and outer pipe strings through the ports.

23 Claims, 6 Drawing Figures

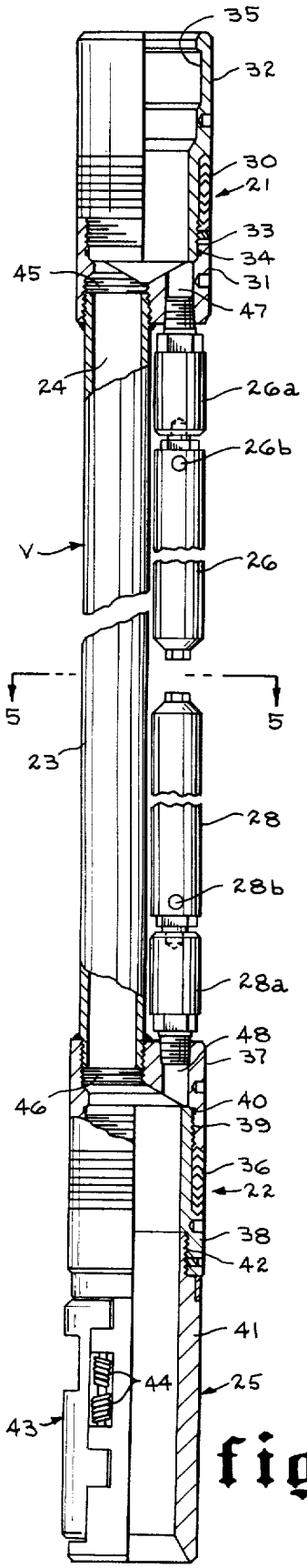
fig.4
fig.6
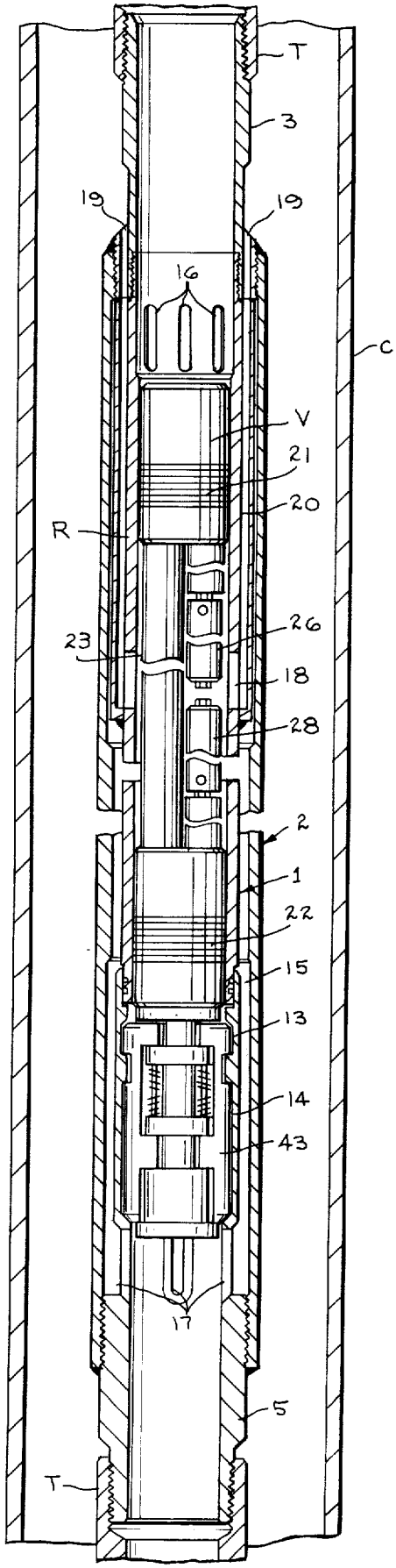

ARTIFICIAL LIFT WELL APPARATUS

BACKGROUND OF THE INVENTION

1. Field of the Invention

The present invention relates generally to well apparatus. In particular, it pertains to apparatus for artificially lifting fluids through a well conduit. Still more specifically, the invention concerns a receiver for connection in a well conduit and a corresponding tool for installation in the receiver to control injection of gas into a column of liquid.

2. Brief Description of the Prior Art

Petroleum wells normally employ a tubing string extending from the surface of the well into a producing formation. The tubing string is usually concentrically surrounded by a larger diameter casing string. In many wells, the producing formation is under sufficient pressure to force the petroleum liquids up the tubing string. However, the producing formation of many other wells may lack the natural pressure necessary for natural flow of liquids to the surface. In such cases, an artificial form of lift must be employed. One popular method of artificial lift is "gas lifting". In gas lifting, a relatively high pressure gas is injected into the liquid to be produced, in order to aerate or lighten the fluid column to produce a mixture of lower specific gravity and induce flow of the mixture to the surface. Some gas lift systems are continuous while others are intermittent.

In contrast to petroleum producing formations, water-bearing formations are almost always without sufficient pressure for a natural flow production. Therefore, some form of artificial lift must be provided. Most water wells of the past have usually been provided with a mechanical pump of some type to lift the water to the surface. However, gas lift systems may also be utilized in providing artificial lift for water wells.

In gas lift systems, wheter used on petroleum or water wells, a tubing string is usually concentrically surrounded by a larger diameter casing string. Gas lift valves may be attached at one or more levels along the tubing string for controlling injection of gas into the fluid column to be lifted. In many wells, the gas is injected through the casing string into the tubing string through which the fluid being produced flows. However, the opposite is true in many cases, i.e. gas is injected through the tubing string into the surrounding fluid column within the casing string. Such a method may be resorted to when it is desirable to move very large volumes of fluids.

In the past, whether fluid production is through the tubing or casing string, gas lift valves have been attached to the tubing string as it is run into the well. Such installations require pulling the tubing string in order to replace or repair a malfunctioning valve. More recently, receivers have been provided for connection in the tubing string so as to allow installation or removal of the gas lift valves through the tubing string without having to pull the tubing string itself. In such cases, the gas lift valves may be run on a wire line or pumpdown tool to a corresponding receiver where it is latched into place. The valve is sealingly placed into communication with some kind of port through which gas is injected into the desired column, whether it is the tubing string or casing string.

The tubing string is limited in flow area and with the installation of gas valves therein is even further limited. This creates somewhat of a problem where relatively high volumes of flow are desired. This is particularly true in cases where gas is injected from the tubing string into the casing string for high volume fluid production. Such is the case in water wells which are produced for high volume water flood operations. Such high volume requirements are more frequent in today's global search for petroleum.

Another problem encountered in high rates of injection and flow is erosion. With normal gas lift operations the ports through which the gas is injected normally open directly toward the wall of the surrounding pipe string. With the extreme flows required in high volume production, the gas may erode and eventually cut through the casing wall, necessitating a complex and extremely costly remedial operation. In fact, it may even result in abandonment of such a well. Another problem encountered in extreme flows is thermal expansion due to the increased temperatures resulting from such high flows. Conventional gas lift installations of the past do not suitably provide for such thermal expansion.

SUMMARY OF THE PRESENT INVENTION

The present invention pertains to apparatus, including a receiver and corresponding well tool, for use in a high volume well. The apparatus is particularly suitable for gas injection through a tubing string into a surrounding casing string through which fluids are to be produced at high volumes, e.g. large capacity water wells for water flooding. The receiver may comprise an inner tubular member having means for connecting it in the tubing string and an outer tubular member creating an annular passageway therebetween, each end of the passageway being in fluid communication with the inner tubular member and tubing string. The inner tubular member may also be provided with latch recesses in which the well tool may be latched.

The well tool is adapted for movement through the tubing string into engagement with the latch recesses of the inner tubular member of the receiver. The well tool carries at least one valve for controlling fluid communication between the tubing string and surrounding casing string through ports provided in the receiver. The well tool may also be provided with a cylindrical passageway through which a portion of the gas flow may pass through the receiver. Thus, some gas is injected through the valve or valves into the surrounding casing string while the remainder passes through the annular receiver passageway and the well tool passageway to lower gas lift valve installations. This permits a relatively large volume of gas to be carried through the tubing string.

Another feature of the well tool is the eccentric arrangement of its valves and cylindrical passageway so that other well tools, such as pressure "bombs" or indicators, may be passed therethrough.

Another feature of the receiver is an expansion joint, within the inner tubular member, to compensate for thermal expansion.

Still another feature of the receiver is the arrangement of its injection ports so as to direct the injected gas in a path generally parallel with the axis of the pipe strings to reduce the harmful effects of erosion.

Many other objects and advantages of the invention will become apparent from a reading of the specification which follows in conjunction with the accompanying drawings.

BRIEF DESCRIPTION OF THE DRAWINGS

FIG. 4 is a partially sectioned elevation view of a well tool, according to a preferred embodiment of the invention, for installation in a receiver such as the one shown in FIG. 2;

FIG. 6 is an elevation view, partially in section, showing the well tool of FIGS. 4 and 5 installed in the receiver of FIGS. 2 and 3, according to a preferred embodiment of the invention.

DESCRIPTION OF A PREFERRED EMBODIMENT

Figure 1:
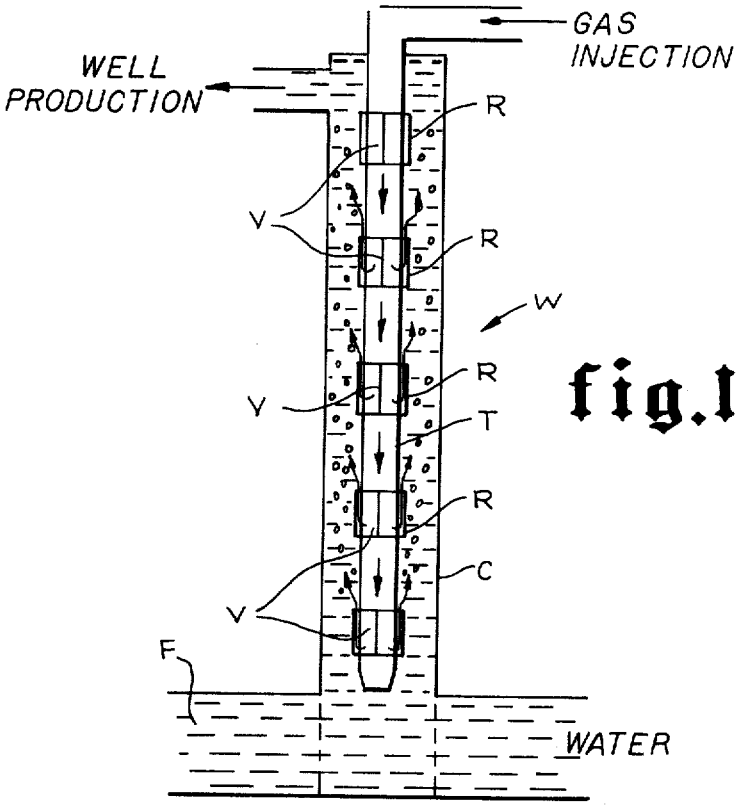
FIG. 1 is a schematic representation of a well, embodying apparatus according to the present invention, in which gas is being injected through the tubing string for lifting fluids through the casing string.

Referring first to FIG. 1, there is schematically represented a well W through which a subterranean water-bearing formation F is produced. The well may comprise a tubing string T and a surrounding casing string C. The casing string C is perforated near the water-bearing formation F to allow flow of water into the casing string C.

At preselected levels along the tubing string T, receivers R are provided. Held in place by receivers R are corresponding well tools V which include gas lift valves. High pressure gas is introduced at the surface of the well, through tubing T, and injected through well tools V and receivers R into the fluid column in the casing string C. The gas is mixed with the water, aerating the fluid column, causing the gas and water mixture to flow upwardly in the well for production at the surface thereof.

Figure 2:
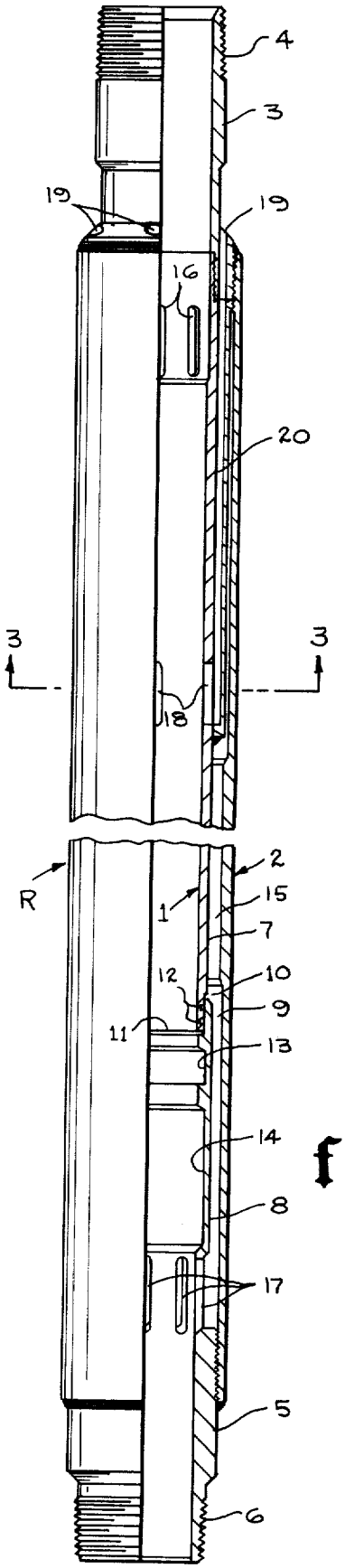
FIG. 2 is a vertical elevation view, in quarter section of a receiver assembly according to a preferred embodiment of the invention.
Figure 3:
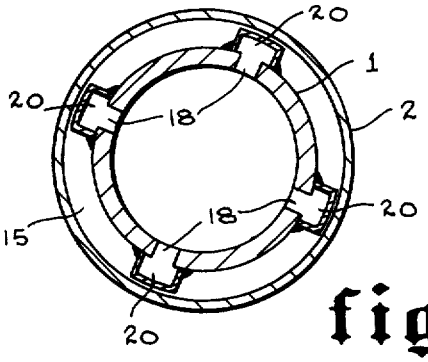
FIG. 3, taken along line 3—3 of FIG. 2, is a horizontal cross-section of the receiver assembly.

Referring now to FIGS. 2 and 3, a receiver R, such as those represented in FIG. 1, will be more fully described. The receiver basically comprises a first or inner tubular member 1 and a surrounding second or outer tubular member 2. The inner tubular member may comprise an upper pin member 3 having threads 4 thereon for connecting the receiver to the tubing string. A lower pin member 5 with threads 6 may also be provided for connecting to the subadjacent tubing string joint.

The inner tubular member 1 may actually include an upper portion 7 and a lower portion 8 connected by an expansion joint 9. The exterior of the lower end of upper portion 7 and the interior of the upper end of lower portion 8 may be relieved to provide an interconnecting telescopic sliding fit. Upon assembly, slight gaps, e.g. ⅛ inch, should be left at 10 and 11. One of the upper and lower portions 7 and 8 may be provided with recesses for receiving one or more metallic seal rings 12. These seal rings 12 provide a measure of sealing but also allow "breathing" of the joint. The purpose of the joint 9 is to accommodate thermal expansion which occurs under extreme flow conditions. If such a joint is not provided, thermal expansion may cause buckling of weaker sections, such as the lower portion 8, preventing proper landing of tools within the receiver.

The lower portion 8 may be provided with latch recesses 13 and 14 which correspond with the latch profile of a tool to be received in the receiver, as will be more fully understood hereafter.

The exterior of inner tubular member 1 and the interior of outer tubular member 2 define an annular flow passage or by-pass 15 through which a major portion of the tubing gas flow may pass. To this end, upper and lower apertures 16 and 17, respectively, may be provided in the walls of inner tubular member 1 to provide fluid communication between the annular space 15 and the tubing string.

It will also be noted that intermediate apertures 16 and 17 are a plurality of other apertures or ports 18. The purpose of these ports 18 is to provide fluid communication between the tubing string and the surrounding casing string. To complete such communication, ports 19 on the exterior of the receiver R and a connecting conduit or channel 20 is provided. A short route for such communication could be provided by making the port 19 through the walls of the outer tubular member 2 at the same level as port 18. However, high pressure and high volume flow through such a port would create erosion problems in the surrounding casing string. For this reason, the elongated longitudinal channel 20 and port 19 are constructed, as shown in FIG. 2, having axes generally parallel with the axis of the tubing string, so that gas exiting through port 19 will be in the general direction of the surrounding casing flow to minimize erosion problems. As can be seen both in FIG. 2 and FIG. 3, the elongated conduit or channel 20 is generally disposed in the annular space 15 and may be conveniently formed by welding a channel-shaped member to the inner tubular member 1 as shown.

Figure 5:
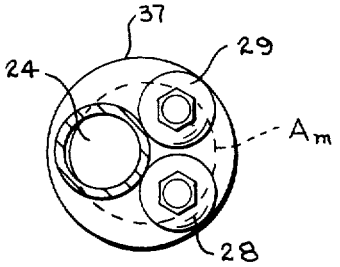
FIG. 5, taken along line 5—5 of FIG. 4, is a horizontal cross-section of the well tool of FIG. 4.

Referring now to FIGS. 4 and 5, a well tool, such as the ones generally indicated at V in FIG. 1, will be described. Such a tool may comprise a pair of cylindrical seal assemblies 21 and 22 connected by a tubular mandrel 23 having a cylindrical passageway 24 therethrough. A latch assembly 25 and a plurality, four in the illustrated embodiment, of gas lift valves 26, 27, 28, and 29 may also be provided. The gas lift valves illustrated are of the pressure bellows operated type and may include check valves 26*a*, 27*a*, 28*a* and 29*a*, respectively, through which gas enters the valve. Gas exits the valves for eventual injection into the fluid column within the casing string through ports 26*b*, 27*b*, 28*b*, 29*b*. Basically, the gas valves operate in response to pressures in the fluid column to control the flow of gas from the tubing string into the surrounding casing string. The operation of such valves is well known and will be no further described. In fact, several types of valves may be used with the apparatus of the present invention.

The upper seal assembly 21 may comprise a seal 30 such as one of the chevron-type, held between a collar member 31 and connected tubular extension 32. Suitable connection threads 33 and seal ring 34 may be provided. The upper extension 32 may be provided with an internal recess 35 for connection with suitable running tools. As will be more fully discussed hereafter, the internal running and pulling recess is preferred to one of the external or "neck" type.

The lower seal assembly 22 may also comprise a seal, such as chevron 36, sandwiched between collar member 37 and tubular body 38. Connection threads 39 and seal ring 40 are also provided. Both seal assemblies 21 and 22 are of the proper dimension to seal within the bore of the upper portion of receiver inner tubular member 1 on opposite sides of ports 18.

The latch assembly 25 may comprise a tubular body 41 threadedly connected at 42 to the lower seal assembly body 38. A plurality of latches 43 are carried by the latch body 41 within suitable windows or apertures for movement between retracted positions and the extended positions shown in FIG. 4. Springs 44 are provided for biasing the latches 43 toward the extended position. These type of latches, which are known in the industry, may be provided with profiles corresponding with the profile of receiver latch grooves 13 and 14 so that the latches 43 selectively engage only the particular receiver R for which it is intended, bypassing other receivers R as it is lowered through a tubing string.

It should be noted that the axis of tubular mandrel 23 is eccentrically disposed relative to the axis of the tubing string through which it will pass. This is to allow the mounting of gas lift valves 26–29 in such a fashion as to take up the least possible cross-sectional area. Thus, the axis of valves 27–29 are also eccentrically disposed relative to the tubing string axis. Upper gas lift valves 26 and 27 are, of course, angularly displaced from each other but at the same general elevation. Likewise, lower valves 28 and 29 are angularly displaced, relative to each other, but at the same general elevation.

When connected in the tubing string, tubular mandrel passageway 24, via collar ports 45 and 46, provide continuing flow communication through the tubing string. A portion of the gas flow may enter the gas lift valves, via collar ports 47 and 48. As best shown in FIG. 5, the internal cross-sectional area of passageway 24 generally lies within a cylinder formed by the longitudinal projection of the minor internal cross-sectional areas $A_m$ of extension 32 and seal body 38. Thus, other well tools, such as pressure "bombs" or the like, may be lowered through the well tool V without encountering obstructions to its path. This is also why it is important to have an internal type running and pulling extension 32 as opposed to the external type which has a much smaller flow diameter.

OPERATION

Referring now to all the drawings, FIG. 6 in particular, the operation of the present invention will be described. As is readily understood, the receiver R is initially attached at predetermined locations in the tubing string T as the tubing string is run into the well. Then the well tool V is attached to a suitable wire line or pumpdown type running tool and lowered from the surface of the well through the tubing string T. The well tool latches 43 are forced inwardly until they engage the corresponding recesses 13 and 14 of the corresponding receiver R. When this point is reached, the well tool V is latched properly in place within the inner tubular member 1 of receiver R. Seals 21 and 22 properly engage the inner receiver tubular member to isolate ports 18. After all valves are in place, gas injection may take place. Gas flows downwardly through the tubing string and in each receiver, a portion flows through well tool passage 24, receiver by-pass 15 and when the gas lift valves are open through the gas lift valves for injection into the surrounding casing string. When the gas lift valves are open, gas exits through ports 26*b*, 27*b*, 28*b*, 29*b*, receiver ports 18 and 19, via conduits 20 into the fluid column in the surrounding casing string C. The gas aerates and lightens the fluid column creating the lift necessary to produce the mixture at high rates of flow. Since a plurality of gas lift valves are provided, this rate can be extremely high. Furthermore, due to the well tool passage 24 and receiver bypass 15, large volumes of gas may continue through the apparatus for properly supplying well tools V located at lower elevation positions.

In addition to providing large volumes of gas injected flow not possible with prior art gas lift systems, erosion associated with such high flow systems is substantially eliminated. Furthermore, the problems associated with thermal expansion due to high flows is also eliminated with the present invention. These capabilities are made possible by a compact assembly which also permits passage of other well tools, is of relatively simple construction and easy to manufacture, maintain and operate.

Although only one preferred embodiment of the invention has been described herein, many variations of the invention will be apparent to those skilled in the art. It is therefore intended that the scope of the invention be limited only by the claims which follow.

I claim:

1. Apparatus for use in a well having an outer pipe string for flow of a first fluid and an inner pipe string for flow of a second fluid, comprising in combination: receiver means adapted for connection in said inner pipe string and having port means providing communication between said inner and outer pipe strings; and a well tool adapted for movement through said inner pipe string into sealing engagement with said receiver means, said well tool having valve means for controlling fluid flow between said inner and outer pipe strings through said port means; said receiver means including first tubular means adapted for reception of said well tool and through which said fluid communication between said inner and outer pipe string is established, and second tubular means concentrically surrounding said first tubular means and laterally spaced therefrom to define an annular passageway therebetween that communicates with said first tubular means above and below the sealing engagement of said well tool with said receiver means and through which at least a portion of said second fluid flow may by-pass said well tool.

2. The combination of claim 1 including a cylindrical latch assembly carried by said well tool engageable with a corresponding latch recess carried by said receiver means to latch said well tool within said receiver means.

3. The combination of claim 1 in which said first tubular means comprises an upper tubular member and a lower tubular member connected to each other in a telescopically sliding expansion joint.

4. The combination of claim 3 in which one of said upper and lower tubular members carries, at said expansion joint, a metallic ring sealingly and slidingly engaging the other.

5. The combination of claim 1 in which said port means comprises a first port in the walls of said first tubular means, a second port through an exterior wall of said receiver means and a connecting flow conduit therebetween.

6. The combination of claim 2 in which the axis of said second port is substantially parallel with the axis of said pipe strings.

7. The combination of claim 6 in which said flow conduit comprises an elongated channel passing through said annular passageway.

8. The combination of claim 1 in which said receiver means has upper and lower apertures defining the respective upper and lower ends of said annular passageway, said sealing engagement being provided by seal means on said well tool engageable with said first tubular means between said upper and lower apertures to isolate said port means from said by-passing fluid flow.

9. The combination of claim 8 in which said seal means comprises an upper cylindrical seal assembly and a lower cylindrical seal assembly, the interiors of which are connected by an intermediate tubular member whose axis is eccentrically disposed relative to the axis of said inner pipe string, the internal cross-sectional area of said intermediate tubular member lying within a cylinder formed by the longitudinal projection of the minor internal cross-sectional areas of said cylindrical seal assemblies to allow unobstructed passage of tools through said intermediate tubular member.

10. The combination of claim 9 in which said valve means comprises at least two cylindrical valves, the axes of which are eccentrically disposed relative to said pipe string.

11. The combination of claim 10 in which one of said valves is attached to said upper cylindrical seal assembly and communicates with the interior thereof, another of said valves being attached to said lower cylindrical seal assembly and communicating with the interior thereof.

12. The combination of claim 10 in which two of said valves are attached to one of said cylindrical seal assemblies in communication with the interior thereof.

13. Receiver means adapted for receiving well tools at predetermined locations in a pipe string extending into a well, said receiver means comprising: first tubular means having means at its ends for connecting said receiver means in said pipe string in fluid communication therewith; latch detent means within said first tubular means for selectively stopping and latching a tool therein; port means in said receiver means for communicating the bore of said first tubular means with the exterior of said receiver means; an upper seal surface on the wall of said bore above said port means and a lower seal surface on the wall of said bore below said port means and second tubular means surrounding said first tubular means and providing an annular passageway therebetween, one end of said passageway being in fluid communication with said first tubular means above said upper seal surface and the other end of said passageway being in fluid communication with said first tubular means below said lower seal surface.

14. Receiver means as set forth in claim 13 in which said port means comprises a first port in the wall of said first tubular means, a second port on said exterior of said receiver means and a flow conduit therebetween.

15. Receiver means as set forth in claim 14 in which the axis of said second port is substantially parallel with the axis of said pipe string so as to direct fluids exiting therefrom in a direction generally parallel with the axis of said pipe string.

16. Receiver means as set forth in claim 14 in which said flow conduit comprises an elongated channel passing through said annular passageway within said second tubular means.

17. Receiver means as set forth in claim 13 in which said first tubular means comprises a first tubular member joining a second tubular member in an expansion joint.

18. Receiver means as set forth in claim 17 in which adjacent ends of each of said tubular members mutually and telescopically engage each other in a close sliding fit.

19. Receiver means as set forth in claim 18 in which said mutually and telescopically engaged ends are provided with seal means therebetween, said seal means comprising at least one metallic seal ring carried by one of said ends and sealingly engaging the other.

20. In combination with the receiver means of claim 13, a well tool movable through said pipe string comprising: a tubular mandrel having a passageway therethrough; a latch assembly attached to said mandrel for engagement with said latch detent means to stop and latch said well tool therein; an upper seal assembly carried by said mandrel and engageable with said upper seal surface and a lower seal assembly carried by said mandrel and engageable with said lower seal surface; and valve means on said mandrel for controlling fluid communication between said mandrel and said port means.

21. The combination of claim 20 in which said valve means comprises a plurality of valves responsive to a predetermined pressure externally of said receiver means to open and permit said fluid communication.

22. The combination of claim 21 in which the axes of said mandrel and said valves are eccentrically offset from the axis of said receiver means.

23. The combination of claim 22 in which at least one of said valves is longitudinally displaced relative to another of said valves.

24. The combination of claim 23 in which there are at least two of said valves angularly displaced relative to said receiver axis but at the same relative longitudinal position.

25. The combination of claim 22 in which at least one of said valves is angularly displaced relative to another of said valves but at the same longitudinal position relative to said receiver axis.

* * * * *